US007937209B2

(12) United States Patent
Dudek et al.

(10) Patent No.: US 7,937,209 B2
(45) Date of Patent: May 3, 2011

(54) AIR FUEL RATIO CONTROL SYSTEM FOR INTERNAL COMBUSTION ENGINES

(75) Inventors: Kenneth P. Dudek, Rochester Hills, MI (US); Sai S. V. Rajagopalan, Columbus, OH (US); Stephen Yurkovich, Columbus, OH (US); Yann G. Guezennec, Columbus, OH (US); Shawn W. Midlam-Mohler, Columbus, OH (US); Louis A. Avallone, Milford, MI (US); Igor Anilovich, Walled Lake, MI (US)

(73) Assignee: GM Global Technology Operations LLC

( * ) Notice: Subject to any disclaimer, the term of this patent is extended or adjusted under 35 U.S.C. 154(b) by 357 days.

(21) Appl. No.: 12/188,607

(22) Filed: Aug. 8, 2008

(65) Prior Publication Data

US 2009/0048766 A1 Feb. 19, 2009

Related U.S. Application Data

(60) Provisional application No. 60/956,585, filed on Aug. 17, 2007.

(51) Int. Cl.
*F02D 41/30* (2006.01)
*F02D 41/00* (2006.01)

(52) U.S. Cl. ..... 701/109; 123/672

(58) Field of Classification Search ..... 123/672, 123/478, 480, 486, 494; 701/104, 109; 60/276
See application file for complete search history.

(56) References Cited

U.S. PATENT DOCUMENTS

| | | | | |
|---|---|---|---|---|
| 5,056,308 | A * | 10/1991 | Kume et al. | 60/276 |
| 6,055,963 | A * | 5/2000 | Brown et al. | 123/525 |
| 6,481,201 | B2 * | 11/2002 | Kako et al. | 60/285 |
| 6,502,389 | B2 * | 1/2003 | Katayama et al. | 60/285 |
| 6,634,170 | B2 * | 10/2003 | Hiranuma et al. | 60/295 |
| 2002/0157381 | A1 * | 10/2002 | Kakuyama et al. | 60/276 |
| 2004/0055278 | A1 * | 3/2004 | Miyoshi et al. | 60/272 |
| 2005/0075781 | A1 * | 4/2005 | Mizuno et al. | 701/109 |
| 2006/0242950 | A1 * | 11/2006 | Wang et al. | 60/295 |

FOREIGN PATENT DOCUMENTS

| | | | |
|---|---|---|---|
| DE | 4128718 | A1 | 3/1993 |
| DE | 102005059794 | | 3/2007 |
| EP | 0972928 | A1 | 1/2000 |

* cited by examiner

*Primary Examiner* — Stephen K Cronin
*Assistant Examiner* — Arnold Castro

(57) ABSTRACT

A fuel control system of an engine system comprises a pre-catalyst exhaust gas oxygen (EGO) sensor and a control module. The pre-catalyst EGO sensor determines a pre-catalyst EGO signal based on an oxygen concentration of an exhaust gas. The control module determines at least one fuel command and determines at least one expected oxygen concentration of the exhaust gas. The control module determines a final fuel command for the engine system based on the pre-catalyst EGO signal, the fuel command, and the expected oxygen concentration.

32 Claims, 6 Drawing Sheets

AIR FUEL RATIO CONTROL SYSTEM FOR INTERNAL COMBUSTION ENGINES

CROSS-REFERENCE TO RELATED APPLICATIONS

This application claims the benefit of U.S. Provisional Application No. 60/956,585, filed on Aug. 17, 2007. The disclosure of the above application is incorporated herein by reference in its entirety.

FIELD

The present disclosure relates to engine control systems, and more particularly to fuel control systems for internal combustion engines.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A fuel control system reduces emissions of a gasoline engine. The fuel control system may include an inner feedback loop and an outer feedback loop. The inner feedback loop may use data from an exhaust gas oxygen (EGO) sensor arranged before a catalytic converter of the engine system (i.e., a pre-catalyst EGO sensor) to control an amount of fuel sent to the engine.

For example, when the pre-catalyst EGO sensor senses a rich air/fuel ratio in an exhaust gas (i.e., non-burnt fuel vapor), the inner feedback loop may decrease a desired amount of fuel sent to the engine (i.e., decrease a fuel command). When the pre-catalyst EGO sensor senses a lean air/fuel ratio in the exhaust gas (i.e., excess oxygen), the inner feedback loop may increase the fuel command. This maintains the air/fuel ratio at true stoichiometry, or an ideal air/fuel ratio, improving the performance (e.g., the fuel economy) of the fuel control system.

The inner feedback loop may use a proportional-integral control scheme to correct the fuel command. The fuel command may be further corrected based on a short term fuel trim or a long term fuel trim. The short term fuel trim may correct the fuel command by changing gains of the proportional-integral control scheme based on engine operating conditions. The long term fuel trim may correct the fuel command when the short term fuel trim is unable to fully correct the fuel command within a desired time period.

The outer feedback loop may use information from an EGO sensor arranged after the converter (i.e., a post-catalyst EGO sensor) to correct the EGO sensors and/or the converter when there is an unexpected reading. For example, the outer feedback loop may use the information from the post-catalyst EGO sensor to maintain the post-catalyst EGO sensor at a required voltage level. As such, the converter maintains a desired amount of oxygen stored, improving the performance of the fuel control system. The outer feedback loop may control the inner feedback loop by changing thresholds used by the inner feedback loop to determine whether the air/fuel ratio is rich or lean.

Exhaust gas composition affects the behavior of the EGO sensors, thereby affecting accuracy of the EGO sensor values. As a result, fuel control systems have been designed to operate based on values that are different than those reported. For example, fuel control systems have been designed to operate "asymmetrically," (i.e., the threshold used to indicate the lean air/fuel ratio is different than the threshold used to indicate the rich air/fuel ratio).

Since the asymmetry is a function of the exhaust gas composition and the exhaust gas composition is a function of the engine operating conditions, the asymmetry is typically designed as a function of the engine operating conditions. The asymmetry is achieved indirectly by adjusting the gains and the thresholds of the inner feedback loop, requiring numerous tests at each of the engine operating conditions. Moreover, this extensive calibration is required for each powertrain and vehicle class and does not easily accommodate other technologies, including, but not limited to, variable valve timing and lift.

SUMMARY

A fuel control system of an engine system comprises a pre-catalyst exhaust gas oxygen (EGO) sensor and a control module. The pre-catalyst EGO sensor determines a pre-catalyst EGO signal based on an oxygen concentration of an exhaust gas. The control module determines at least one fuel command and determines at least one expected oxygen concentration of the exhaust gas. The control module determines a final fuel command for the engine system based on the pre-catalyst EGO signal, the fuel command, and the expected oxygen concentration.

A method of operating a fuel control system of an engine system comprises determining a pre-catalyst EGO signal based on an oxygen concentration of an exhaust gas; determining at least one fuel command; determining at least one expected oxygen concentration of the exhaust gas; and determining a final fuel command for the engine system based on the pre-catalyst EGO signal, the fuel command, and the expected oxygen concentration.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
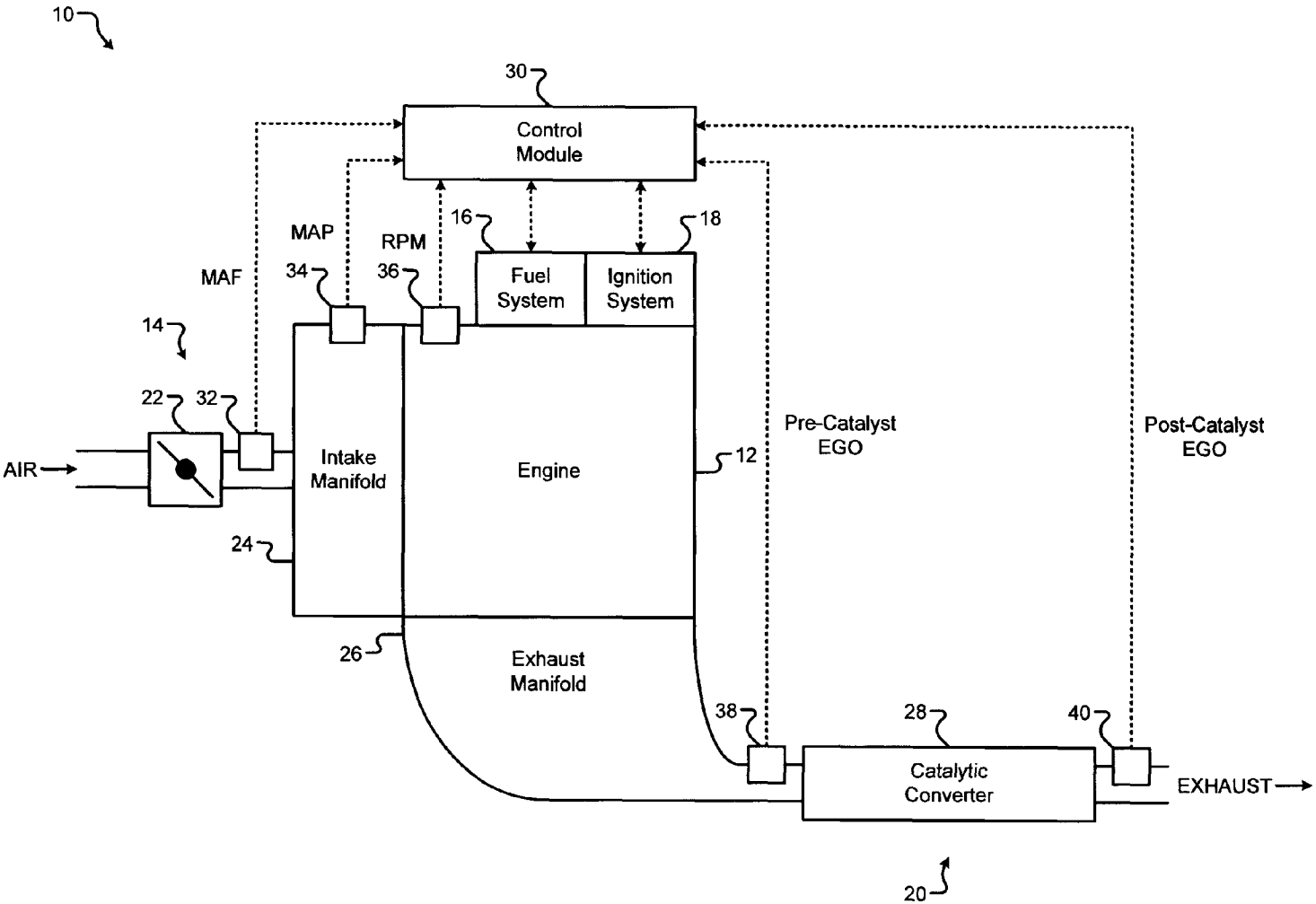
FIG. 1 is a functional block diagram of an exemplary implementation of an engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

To reduce calibration costs associated with conventional fuel control systems, the fuel control system of the present disclosure allows for direct achievement of desired behavior, including asymmetric behavior. In other words, the fuel control system achieves the desired behavior through open loop control instead of closed loop control. Open loop control may include using a model that relates the desired behavior to a fuel command needed to achieve the desired behavior instead of a calibration of closed loop control gains.

In addition, because the fuel control system achieves the desired behavior through open loop control, other control objectives are achieved. For example, fuel commands from several different objectives (e.g., maintaining an amount of oxygen stored in a catalytic converter) are added to a current fuel command, improving the performance of the fuel control system. In another example, the fuel control system accommodates different powertrains (e.g., powertrains with heated oxygen sensors and/or wide range sensors) and vehicle classes.

Referring now to FIG. 1, an exemplary implementation of an engine system 10 is shown. The engine system 10 includes an engine 12, an intake system 14, a fuel system 16, an ignition system 18, and an exhaust system 20. The engine 12 may be any type of internal combustion engine with fuel injection. For example only, the engine 12 may include fuel injected engines, gasoline direct injection engines, homogeneous charge compression ignition engines, or other types of engines.

The intake system 14 includes a throttle 22 and an intake manifold 24. The throttle 22 controls air flow into the engine 12. The fuel system 16 controls fuel flow into the engine 12. The ignition system 18 ignites an air/fuel mixture provided to the engine 12 by the intake system 14 and the fuel system 16.

An exhaust gas created by combustion of the air/fuel mixture exits the engine 12 through the exhaust system 20. The exhaust system 20 includes an exhaust manifold 26 and a catalytic converter 28. The catalytic converter 28 receives the exhaust gas from the exhaust manifold 26 and reduces toxicity of the exhaust gas before it leaves the engine system 10.

The engine system 10 further includes a control module 30 that regulates operation of the engine 12 based on various engine operating parameters. The control module 30 is in communication with the fuel system 16 and the ignition system 18. The control module 30 is further in communication with a mass air flow (MAF) sensor 32, a manifold air pressure (MAP) sensor 34, and an engine revolutions per minute (RPM) sensor 36. The control module 30 is further in communication with an exhaust gas oxygen (EGO) sensor arranged in the exhaust manifold 26 (i.e., a pre-catalyst EGO sensor 38). The control module 30 is further in communication with an EGO sensor arranged after the catalytic converter 28 (i.e., a post-catalyst EGO sensor 40).

The MAF sensor 32 generates a MAF signal based on a mass of air flowing into the intake manifold 24. The MAP sensor 34 generates a MAP signal based on an air pressure in the intake manifold 24. The RPM sensor 36 generates a RPM signal based on a rotational velocity of a crankshaft (not shown) of the engine 12.

The pre-catalyst EGO sensor 38 generates a pre-catalyst EGO signal based on an oxygen concentration level of the exhaust gas in the exhaust manifold 26. The post-catalyst EGO sensor 40 generates a post-catalyst EGO signal based on an oxygen concentration level of the exhaust gas after the catalytic converter 28. For example only, the EGO sensors 38 and 40 may each include, but is not limited to, a switching EGO sensor or an universal EGO (UEGO) sensor. The switching EGO sensor generates an EGO signal in units of voltage and switches the EGO signal to a low or a high voltage when the oxygen concentration level is lean or rich, respectively. The UEGO sensor generates an EGO signal in units of equivalence ratio and eliminates the switching between lean and rich oxygen concentration levels of the switching EGO sensor.

Figure 2:
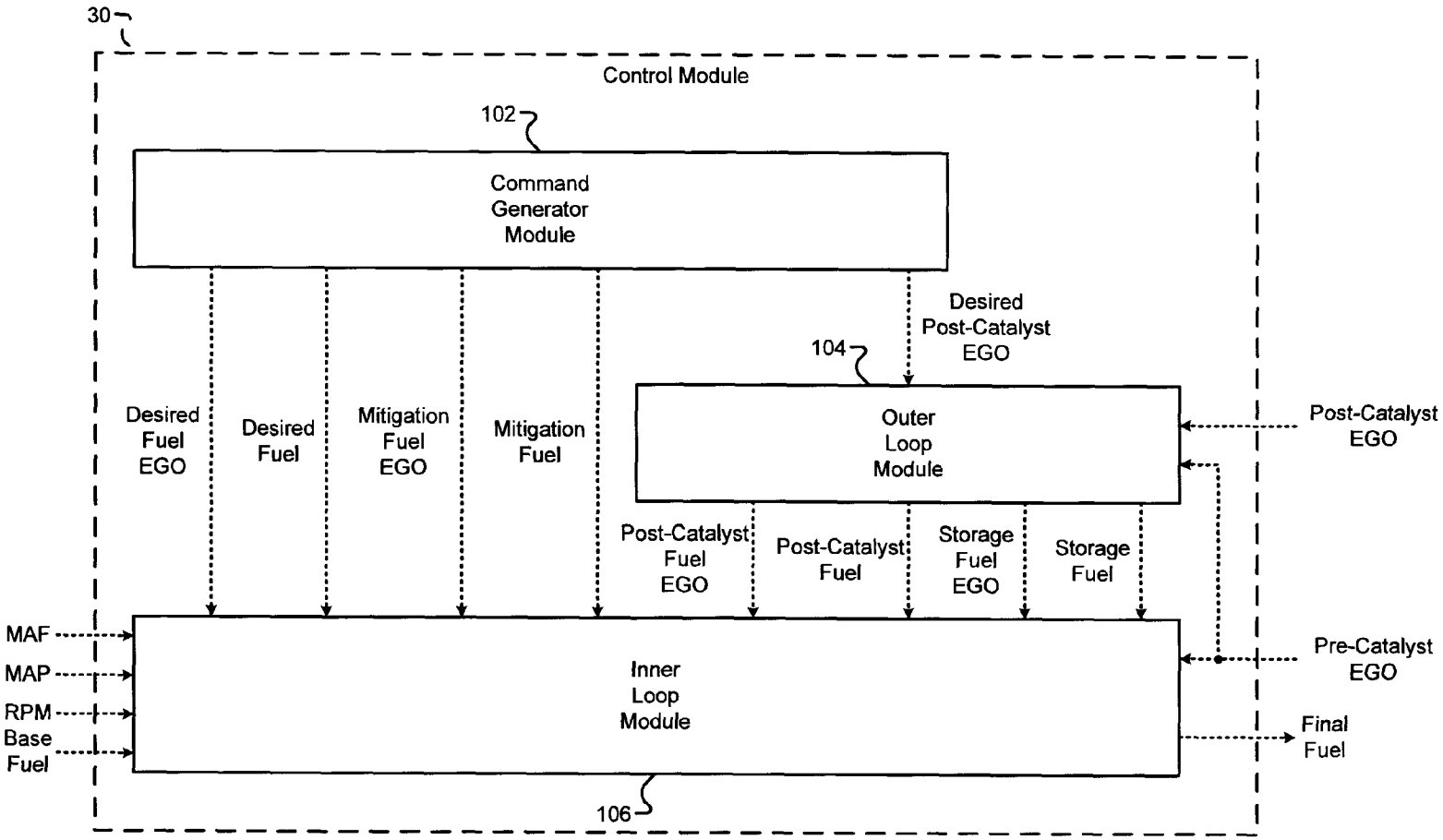
FIG. 2 is a functional block diagram of an exemplary implementation of a control module according to the principles of the present disclosure.

Referring now to FIG. 2, the control module 30 is shown. The control module 30 includes a command generator module 102, an outer loop module 104, and an inner loop module 106. The command generator module 102 determines engine operating conditions. For example only, the engine operating conditions may include, but are not limited, to the rotational velocity of the crankshaft, the air pressure in the intake manifold 24, and/or a temperature of engine coolant.

The command generator module 102 determines a fuel command that will achieve a desired oxygen concentration level of the exhaust gas in the exhaust manifold 26 (i.e., a desired fuel). The command generator module 102 determines the desired oxygen concentration level of the exhaust gas in the exhaust manifold 26 (i.e., a desired pre-catalyst EGO). The command generator module 102 determines the desired pre-catalyst EGO based on a model that relates the desired pre-catalyst EGO to the engine operating conditions. The command generator module 102 determines the desired fuel based on the desired pre-catalyst EGO.

In another implementation, the command generator module 102 determines the desired fuel based on a model that relates the desired fuel to engine operating conditions. Either implementation allows for the direct achievement of the asymmetric behavior of the pre-catalyst EGO sensor 38. The command generator module 102 further determines an expected oxygen concentration level of the exhaust gas in the exhaust manifold 26 (i.e., a desired fuel EGO). The command generator module 102 determines the desired fuel EGO based on a model that relates the desired fuel EGO to the desired pre-catalyst EGO. In another implementation, the command generator module 102 determines the desired fuel EGO based on a model that relates the desired fuel EGO to engine operating conditions.

The command generator module 102 further determines a fuel command that will mitigate effects of one or more forecastable disruptions (i.e., a mitigation fuel) to achieve the desired pre-catalyst EGO. For example only, a forecastable disruption may be a known error in a base (i.e., current) fuel command of the fuel system 16 due to an air prediction error. The command generator module 102 determines the desired pre-catalyst EGO based on a model that relates the desired pre-catalyst EGO to the forecastable disruptions. The command generator module 102 determines the mitigation fuel based on the desired pre-catalyst EGO.

In another implementation, the command generator module 102 determines the mitigation fuel based on a model that relates the mitigation fuel to the forecastable disruptions. Either implementation allows for direct achievement of the asymmetric behavior of the pre-catalyst EGO sensor 38. The command generator module 102 further determines an expected oxygen concentration level of the exhaust gas in the exhaust manifold 26 (i.e., a mitigation fuel EGO). The command generator module 102 determines the mitigation fuel EGO based on a model that relates the mitigation fuel EGO to the desired pre-catalyst EGO. In another implementation, the command generator module 102 determines the mitigation fuel EGO based on a model that relates the mitigation fuel EGO to forecastable disruptions.

The command generator module 102 further determines a desired oxygen concentration level of the exhaust gas after exiting the catalytic converter 28 (i.e., a desired post-catalyst EGO). The command generator module 102 determines the desired post-catalyst EGO based on the engine operating conditions. The desired post-catalyst EGO is equivalent to a desired oxygen storage level in the catalytic converter 28.

The outer loop module 104 receives the desired post-catalyst EGO (i.e., the desired oxygen storage level), the post catalyst EGO, and the pre-catalyst EGO. The outer loop module 104 estimates an oxygen storage level in the catalytic converter 28 based on a model that relates the oxygen storage level to the post-catalyst and the pre-catalyst EGOs. The outer loop module 104 maintains the oxygen storage level at the desired oxygen storage level. This maximizes the efficiency of the catalytic converter 28 to convert toxins of the exhaust gas to less-toxic substances. To further maintain the oxygen storage level at the desired oxygen storage level, the outer loop module 104 maintains the post-catalyst EGO at the desired post-catalyst EGO.

When the oxygen storage level is not equal to the desired oxygen storage level or when the pre-catalyst EGO indicates stoichiometry after indicating a lean air/fuel ratio for an predetermined time period, the outer loop module 104 determines a fuel command that will achieve the desired oxygen storage level (i.e., a storage fuel). The outer loop module 104 determines the storage fuel based on a model that relates the storage fuel to the estimated oxygen storage level. The outer loop module 104 further determines an expected oxygen concentration level of the exhaust gas in the exhaust manifold 26 (i.e., a storage fuel EGO). The outer loop module 104 determines the storage fuel EGO based on a model that relates the storage fuel EGO to the estimated oxygen storage level.

The outer loop module 104 determines a post-catalyst EGO correction factor to minimize an error between the desired post-catalyst EGO and the post-catalyst EGO. The outer loop module 104 determines a fuel command that will achieve the desired post-catalyst EGO (i.e., a post-catalyst fuel). The outer loop module 104 determines the post-catalyst fuel based on a model that relates the post-catalyst fuel to the post-catalyst EGO correction factor. The outer loop module 104 further determines an expected oxygen concentration level of the exhaust gas in the exhaust manifold 26 (i.e., a post-catalyst fuel EGO). The outer loop module 104 determines the post-catalyst fuel EGO based on a model that relates the post-catalyst fuel EGO to the post-catalyst EGO correction factor.

The inner loop module 106 receives the post-catalyst fuel EGO, the post-catalyst fuel, the storage fuel EGO, the storage fuel, the desired fuel EGO, the desired fuel, the mitigation fuel EGO, and the mitigation fuel. The inner loop module 106 further receives the MAF, the MAP, the RPM, the base fuel, and the pre-catalyst EGO. The inner loop module 106 determines a fuel correction factor to minimize an error between the pre-catalyst EGO and an expected oxygen concentration level of the exhaust gas in the exhaust manifold 26. The expected oxygen concentration level in the exhaust manifold 26 is a sum of the desired fuel EGO, the mitigation fuel EGO, the post-catalyst fuel EGO, and the storage fuel EGO. To further minimize the error, the inner loop module 106 modifies the base fuel with the desired fuel, the mitigation fuel, the post-catalyst fuel, and the storage fuel to determine a new fuel command for the fuel system 16 (i.e., a final fuel).

Figure 3:
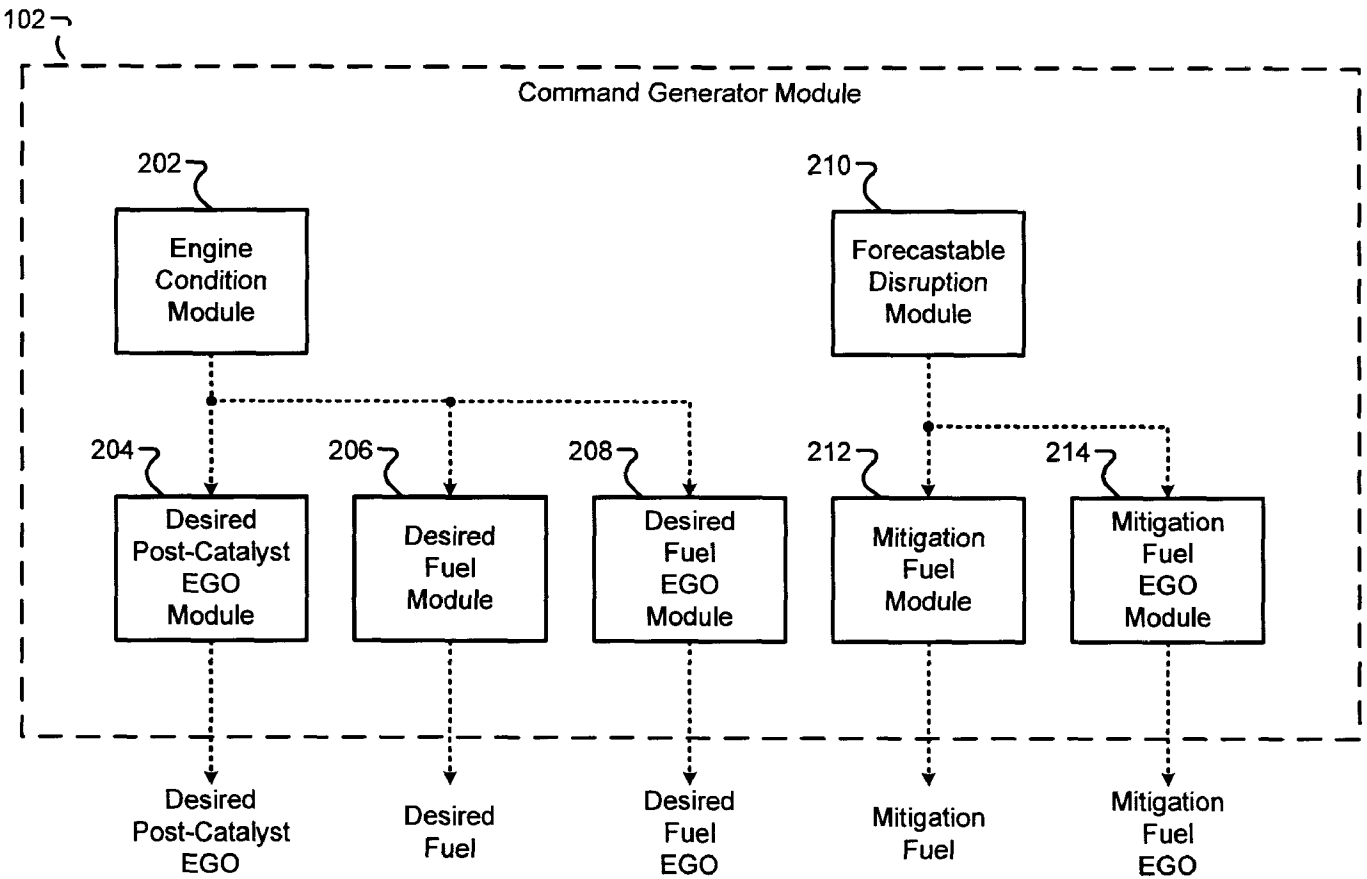
FIG. 3 is a functional block diagram of an exemplary implementation of a command generator module according to the principles of the present disclosure.

Referring now to FIG. 3, the command generator module 102 is shown. The command generator module 102 includes an engine condition module 202, a desired post-catalyst EGO module 204, a desired fuel module 206, and a desired fuel EGO module 208. The command generator module 102 further includes a forecastable disruption module 210, a mitigation fuel module 212, and a mitigation fuel EGO module 214.

The engine condition module 202 is an open loop command generator that determines engine operating conditions (e.g., the rotational velocity of the crankshaft). The desired post-catalyst EGO module 204 receives data on the engine operating conditions and determines the desired post-catalyst EGO based on the engine operating conditions. The desired post-catalyst EGO is equivalent to the desired oxygen storage level (i.e., a desired oxygen storage).

The desired fuel module 206 receives the data on the engine operating conditions. The desired fuel module 206 determines the desired pre-catalyst EGO based on the model that relates the desired pre-catalyst EGO to the engine operating conditions. The desired fuel module 206 determines the desired fuel based on the desired pre-catalyst EGO. In another implementation, the desired fuel module 206 determines the desired fuel based on the model that relates the desired fuel to the engine operating conditions.

The desired fuel EGO module 208 receives the data on the engine operating conditions. The desired fuel EGO module 208 determines the desired pre-catalyst EGO based on a model that relates the desired pre-catalyst EGO to the engine operating conditions. The desired fuel EGO module 208 determines the desired fuel EGO based on the desired pre-catalyst EGO. In another implementation, the desired fuel EGO module 208 determines the desired fuel EGO based on the model that relates the desired fuel EGO to the engine operating conditions.

The forecastable disruption module 210 is an open loop command generator that determines one or more forecastable disruptions (e.g., error in the base fuel). The mitigation fuel module 212 receives the data on the forecastable disruptions. The mitigation fuel module 212 determines the desired pre-catalyst EGO based on the model that relates the desired pre-catalyst EGO to the forecastable disruptions. The mitigation fuel module 212 determines the mitigation fuel based on the desired pre-catalyst EGO. In another implementation, the mitigation fuel module 212 determines the mitigation fuel based on the model that relates the mitigation fuel to the forecastable disruptions.

The mitigation fuel EGO module 214 receives the data on the forecastable disruptions. The mitigation fuel EGO module 214 determines the desired pre-catalyst EGO based on the model that relates the desired pre-catalyst EGO to the forecastable disruptions. The mitigation fuel EGO module 214 determines the mitigation fuel EGO based on the desired pre-catalyst EGO. In another implementation, the mitigation fuel EGO module 214 determines the mitigation fuel EGO based on the model that relates the mitigation fuel EGO to the forecastable disruptions.

For some forecastable disruptions, the mitigation fuel module 212 may take no action, or determine the mitigation fuel to be zero. This mode of operation is desirable for forecastable disruptions that should be ignored by the inner loop module 106. For example only, a forecastable disruption that may benefit from this mode of operation is deceleration fuel cut off (DFCO), wherein the fuel system 16 stops the fuel flow when the engine 12 decelerates for an extended period of time.

Figure 4:
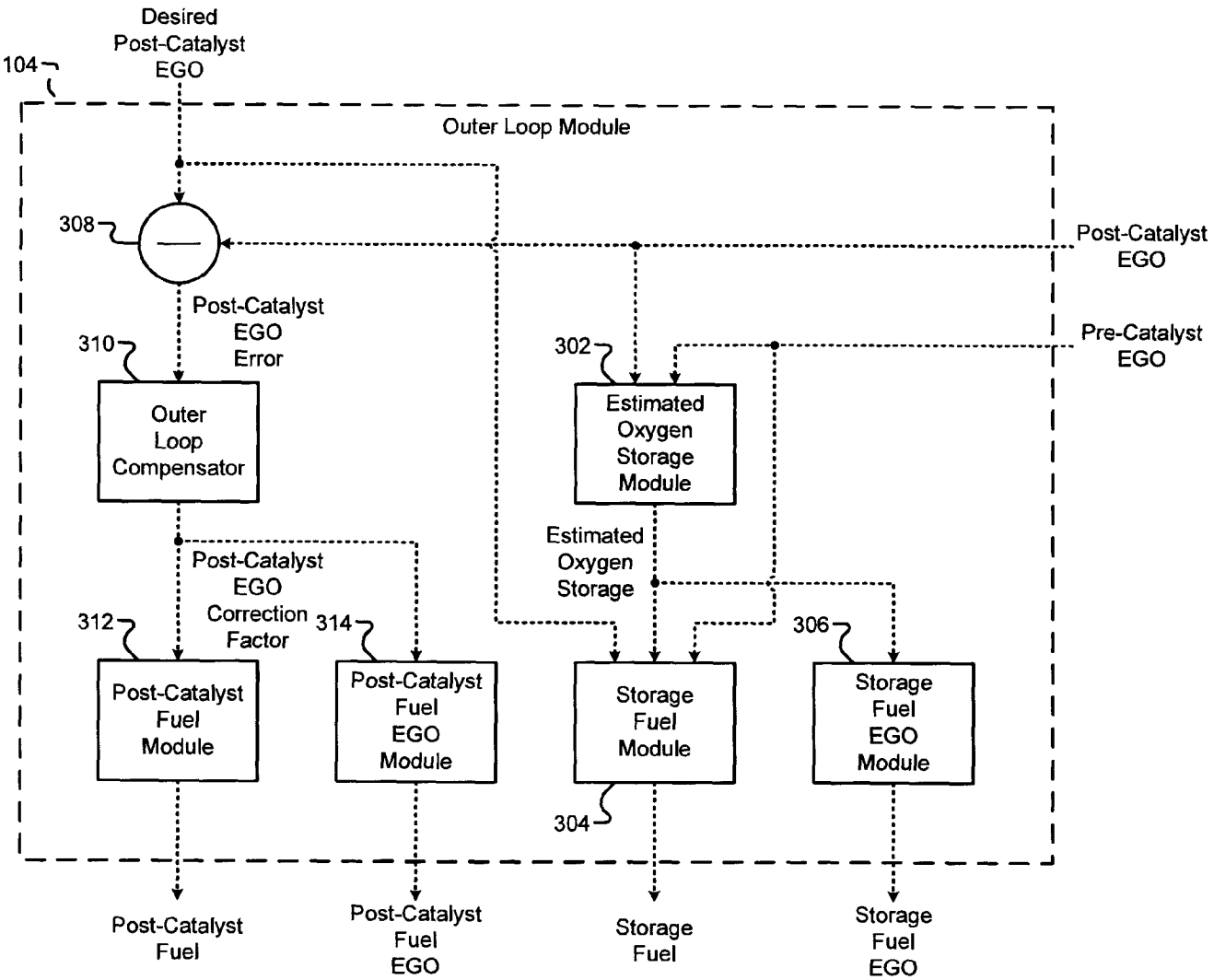
FIG. 4 is a functional block diagram of an outer loop module according to the principles of the present disclosure.

Referring now to FIG. 4, the outer loop module 104 is shown. The outer loop module 104 includes an estimated oxygen storage module 302, a storage fuel module 304, and a storage fuel EGO module 306. The outer loop module 104 further includes a subtraction module 308, an outer loop compensator 310, a post-catalyst fuel module 312, and a post-catalyst fuel EGO module 314. The estimated oxygen storage module 302 receives the post-catalyst and the pre-catalyst EGOs. The estimated oxygen storage module 302 estimates the oxygen storage level (i.e., an estimated oxygen storage) based on the model that relates the estimated oxygen storage to the post-catalyst and the pre-catalyst EGOs.

The storage fuel module 304 receives the estimated oxygen storage, the desired oxygen storage, and the pre-catalyst EGO. When the estimated oxygen storage is not equal to the desired oxygen storage or when the pre-catalyst EGO indicates true stoichiometry after indicating a lean air/fuel ratio for an extended period of time, the storage fuel module 304 determines the storage fuel. The storage fuel module 304 determines the storage fuel based on the model that relates the storage fuel to the estimated oxygen storage. The storage fuel EGO module 306 receives the estimated oxygen storage and determines the storage fuel EGO based on the model that relates the storage fuel EGO to the estimated oxygen storage.

The subtraction module 308 receives the desired post-catalyst EGO and the post-catalyst EGO and subtracts the post-catalyst EGO from the desired post-catalyst EGO to determine a post-catalyst EGO error. The outer loop compensator 310 receives the post-catalyst EGO error and determines a post-catalyst EGO correction factor based on the post-catalyst EGO error. In various implementations, the outer loop compensator 310 may determine the post-catalyst EGO correction factor to be equal to the post-catalyst EGO error. Alternatively, the outer loop compensator 310 may use a proportional-integral control scheme, or other control schemes, to determine the post-catalyst EGO correction factor.

The post-catalyst fuel module 312 receives the post-catalyst EGO correction factor and determines the post-catalyst fuel. The post-catalyst fuel module 312 determines the post-catalyst fuel based on the model that relates the post-catalyst fuel to the post-catalyst EGO correction factor. The post-catalyst fuel EGO module 314 receives the post-catalyst EGO correction factor and determines the post-catalyst fuel EGO based on the model that relates the post-catalyst fuel EGO to the post-catalyst EGO correction factor.

Figure 5:
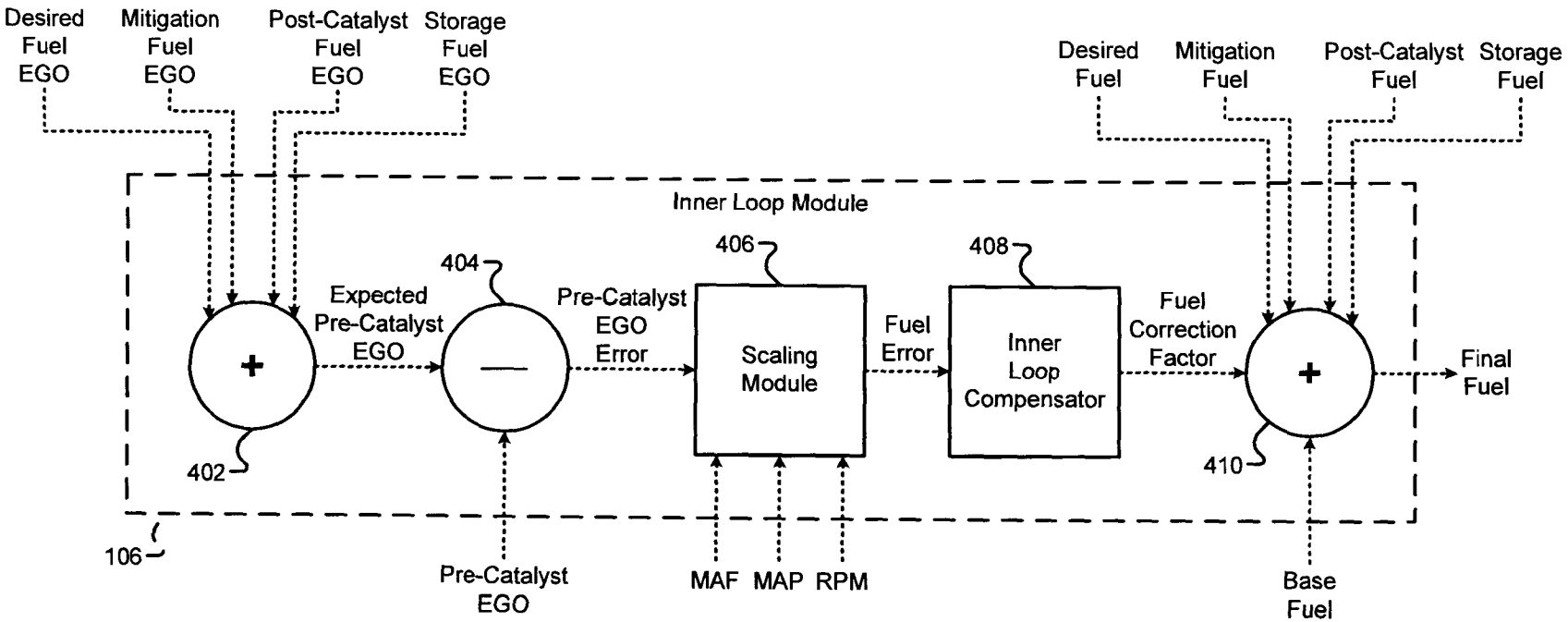
FIG. 5 is a functional block diagram of an exemplary implementation of an inner loop module according to the principles of the present disclosure.

Referring now to FIG. 5, the inner loop module 106 is shown. The inner loop module 106 includes a first summation module 402, a subtraction module 404, a scaling module 406, an inner loop compensator 408, and a second summation module 410. The first summation module 402 receives the desired fuel EGO, the mitigation fuel EGO, the post-catalyst fuel EGO, and the storage fuel EGO.

The first summation module 402 sums the desired fuel EGO, the mitigation fuel EGO, the post-catalyst fuel EGO, and the storage fuel EGO to determine the expected oxygen concentration level in the exhaust manifold 26 (i.e., an expected pre-catalyst EGO). When EGO sensors 38, 40 include typical EGO sensors, summing the desired fuel EGO, the mitigation fuel EGO, the post-catalyst fuel EGO, and the storage fuel EGO may result in too large of a value. If so, the inner loop module 106 may further include a saturation device (not shown), or other comparable logic, that limits the expected pre-catalyst EGO to an expected range of measurements.

The subtraction module 404 receives the expected pre-catalyst EGO and the pre-catalyst EGO and subtracts the pre-catalyst EGO from the expected pre-catalyst EGO to determine a pre-catalyst EGO error. The scaling module 406 receives the pre-catalyst EGO error, the MAF, the MAP, and the RPM. The scaling module 406 converts the pre-catalyst EGO error (e.g., in units of voltage or equivalence ratio) to an equivalent fuel error that is in the same units.

The scaling module 406 determines the fuel error based on the pre-catalyst EGO error and the MAF. The fuel error $error_{fuel}$ is determined according to the following equation:

$$error_{fuel} = \frac{MAF}{14.7} \times error_{EGO}, \tag{1}$$

where MAF is the MAF and $error_{EGO}$ is the pre-catalyst EGO error. In another implementation, the scaling module 406 determines the fuel error based on the pre-catalyst EGO error, the MAP, and the RPM. The fuel error is determined according to the following equation:

$$error_{fuel} = k(\text{MAP, RPM}) \times error_{EGO},$$

where MAP is the MAP, RPM is the RPM, and k is a function of engine operating conditions as indicated by the MAP and the RPM.

The inner loop compensator 408 receives the fuel error and determines a fuel correction factor based on the fuel error. In various implementations, the inner loop compensator 408 may determine the fuel correction factor to simply be equal to the fuel error. Alternatively, the inner loop compensator 408 may use a proportional-integral control scheme, or other control schemes, to determine the fuel correction factor. The second summation module 410 receives the fuel correction factor, the desired fuel, the mitigation fuel, the post-catalyst fuel, the storage fuel, and the base fuel. The second summation module 410 sums the fuel correction factor, the desired fuel, the mitigation fuel, the post-catalyst fuel, the storage fuel, and the base fuel to determine the final fuel.

Figure 6:
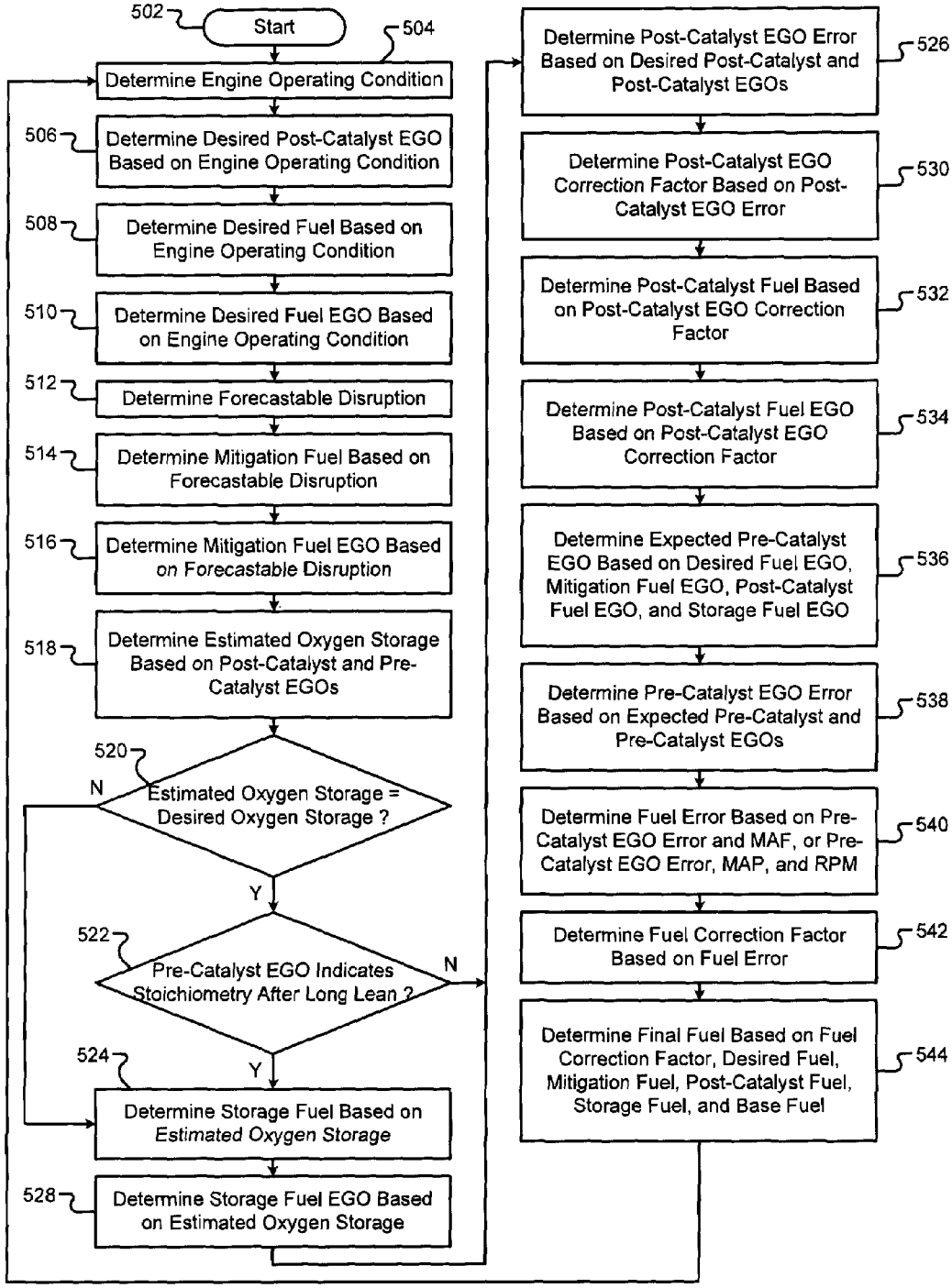
FIG. 6 is a flowchart depicting exemplary steps performed by the control module according to the principles of the present disclosure.

Referring now to FIG. 6, a flowchart depicts exemplary steps performed by the control module 30. Control starts in step 502. In step 504, the engine operating conditions are determined.

In step 506, the desired post-catalyst EGO (i.e., the desired oxygen storage) is determined based on the engine operating conditions. In step 508, the desired fuel is determined based on the engine operating conditions. In step 510, the desired fuel EGO is determined based on the engine operating conditions.

In step 512, the forecastable disruptions are determined. In step 514, the mitigation fuel is determined based on the forecastable disruptions. In step 516, the mitigation fuel EGO is determined based on the forecastable disruptions.

In step 518, the estimated oxygen storage is determined based on the post-catalyst and the pre-catalyst EGOs. In step 520, control determines whether the estimated oxygen storage is equal to the desired oxygen storage. If true, control continues in step 522. If false, control continues in step 524.

In step 522, control determines whether the pre-catalyst EGO indicates true stoichiometry after indicating the lean air/fuel ratio for the extended period of time. If true, control continues in step 524. If false, control continues in step 526.

In step 524, the storage fuel is determined based on the desired oxygen storage. In step 528, the storage fuel EGO is determined based on the desired oxygen storage. Control continues in step 526.

In step 526, the post-catalyst EGO error is determined based on the desired post-catalyst and the post-catalyst EGOs. In step 530, the post-catalyst EGO correction factor is determined based on the post-catalyst EGO error. In step 532, the post-catalyst fuel is determined based on the post-catalyst EGO correction factor.

In step 534, the post-catalyst fuel EGO is determined based on the post-catalyst EGO correction factor. In step 536, the expected pre-catalyst EGO is determined based on the desired fuel EGO, the mitigation fuel EGO, the post-catalyst fuel EGO, and the storage fuel EGO. In step 538, the pre-catalyst EGO error is determined based on the expected pre-catalyst and the pre-catalyst EGOs.

In step 540, the fuel error is determined based on the pre-catalyst EGO error and the MAF, or the pre-catalyst EGO, the MAP, and the RPM. In step 542, the fuel correction factor is determined based on the fuel error. In step 544, the final fuel is determined based on the fuel correction factor, the desired fuel, the mitigation fuel, the post-catalyst fuel, the storage fuel, and the base fuel. Control returns to step 504.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A fuel control system of an engine system, comprising:

a pre-catalyst exhaust gas oxygen (EGO) sensor that determines a pre-catalyst EGO signal based on an oxygen concentration of an exhaust gas; and a control module that determines at least one fuel command and that determines at least one expected oxygen concentration of the exhaust gas, wherein the control module determines a final fuel command for the engine system based on the pre-catalyst EGO signal, the fuel command, and the expected oxygen concentration, and wherein the control module determines a desired oxygen concentration of the exhaust gas exiting a catalytic converter based on a model that relates the desired oxygen concentration to engine operating conditions.

2. The fuel control system of claim 1 wherein the fuel command comprises a desired fuel command that is determined based on a desired oxygen concentration of the exhaust gas in an exhaust manifold.

3. The fuel control system of claim 2 wherein the control module determines the desired oxygen concentration of the exhaust gas in the exhaust manifold based on a model that relates the desired oxygen concentration of the exhaust gas in the exhaust manifold to engine operating conditions.

4. The fuel control system of claim 1 wherein the expected oxygen concentration comprises a first oxygen concentration that is determined based on a model that relates the first oxygen concentration to a desired oxygen concentration of the exhaust gas in an exhaust manifold.

5. The fuel control system of claim 1 wherein the fuel command comprises a desired fuel command that is determined based on a model that relates the desired fuel command to engine operating conditions.

6. The fuel control system of claim 1 wherein the fuel command comprises a mitigation fuel command that is determined based on a desired oxygen concentration of the exhaust gas in an exhaust manifold.

7. The fuel control system of claim 6 wherein the control module determines the desired oxygen concentration of the exhaust gas in the exhaust manifold based on a model that relates the desired oxygen concentration of the exhaust gas in the exhaust manifold to forecastable disruptions of the fuel control system.

8. The fuel control system of claim 1 wherein the expected oxygen concentration comprises a second oxygen concentration that is determined based on a model that relates the second oxygen concentration to a desired oxygen concentration of the exhaust gas in an exhaust manifold.

9. The fuel control system of claim 1 wherein the fuel command comprises a mitigation fuel command that is determined based on a model that relates the mitigation fuel command to forecastable disruptions of the fuel control system.

10. The fuel control system of claim 1 wherein the control module determines the final fuel command based on the pre-catalyst EGO signal and the expected oxygen concentration when the pre-catalyst EGO signal is not equal to the expected oxygen concentration.

11. The fuel control system of claim 1 further comprising a post-catalyst EGO sensor that determines a post-catalyst EGO signal based on an oxygen concentration of the exhaust gas exiting the catalytic converter.

12. The fuel control system of claim 11 wherein the fuel command comprises a storage fuel command that is determined based on a model that relates the storage fuel command to an estimated oxygen storage in the catalytic converter when one of the estimated oxygen storage is not equal to the desired oxygen concentration of the exhaust gas exiting the catalytic converter and the pre-catalyst EGO signal indicates stoichiometry after indicating a lean air/fuel ratio for a predetermined time period.

13. The fuel control system of claim 12 wherein the control module determines the estimated oxygen storage based on the post-catalyst EGO signal and the pre-catalyst EGO signal.

14. The fuel control system of claim 11 wherein the expected oxygen concentration comprises a third oxygen concentration that is determined based on a model that relates the third oxygen concentration to an estimated oxygen storage in the catalytic converter when one of the estimated oxygen storage is not equal to the desired oxygen concentration of the exhaust gas exiting the catalytic converter and the pre-catalyst EGO signal indicates stoichiometry after indicating a lean air/fuel ratio for a predetermined time period.

15. The fuel control system of claim 11 wherein the fuel command comprises a post-catalyst fuel command that is determined based on a model that relates the post-catalyst fuel command to the desired oxygen concentration of the exhaust gas exiting the catalytic converter and the post-catalyst EGO signal when the desired oxygen concentration of the exhaust gas exiting-the catalytic converter is not equal to the post-catalyst EGO signal.

16. The fuel control system of claim 11 wherein the expected oxygen concentration comprises a fourth oxygen concentration that is determined based on a model that relates the fourth oxygen concentration to the desired oxygen concentration of the exhaust gas exiting the catalytic converter and the post-catalyst EGO signal when the desired oxygen concentration of the exhaust gas exiting the catalytic converter is not equal to the post-catalyst EGO signal.

17. A method of operating a fuel control system of an engine system, comprising:

determining a pre-catalyst EGO signal based on an oxygen concentration of an exhaust gas;

determining at least one fuel command;

determining at least one expected oxygen concentration of the exhaust gas;

determining a final fuel command for the engine system based on the pre-catalyst EGO signal, the fuel command, and the expected oxygen concentration; and determining a desired oxygen concentration of the exhaust gas exiting a catalytic converter based on a model that relates the desired oxygen concentration to engine operating conditions.

18. The method of claim 17 further comprising determining a desired fuel command based on a desired oxygen concentration of the exhaust gas in an exhaust manifold.

19. The method of claim 18 further comprising determining the desired oxygen concentration of the exhaust gas in the exhaust manifold based on a model that relates the desired oxygen concentration of the exhaust gas in the exhaust manifold to engine operating conditions.

20. The method of claim 18 further comprising determining a first oxygen concentration based on a model that relates the first oxygen concentration to a desired oxygen concentration of the exhaust gas in an exhaust manifold.

21. The method of claim 17 further comprising determining a desired fuel command based on a model that relates the desired fuel command to engine operating conditions.

22. The method of claim 17 further comprising determining a mitigation fuel command based on a desired oxygen concentration of the exhaust gas in an exhaust manifold.

23. The method of claim 22 further comprising determining the desired oxygen concentration of the exhaust qas in the exhaust manifold based on a model that relates the desired oxygen concentration of the exhaust qas in the exhaust manifold to forecastable disruptions of the fuel control system.

24. The method of claim 17 further comprising determining a second oxygen concentration based on a model that relates the second oxygen concentration to a desired oxygen concentration of the exhaust qas in an exhaust manifold.

25. The method of claim 17 further comprising determining a mitigation fuel command based on a model that relates the mitigation fuel command to forecastable disruptions of the fuel control system.

26. The method of claim 17 further comprising determining a post-catalyst EGO signal based on an oxygen concentration of the exhaust gas exiting the catalytic converter.

27. The method of claim 26 further comprising determining a storage fuel command based on a model that relates the storage fuel command to an estimated oxygen storage in the catalytic converter when one of the estimated oxygen storage is not equal to the desired oxygen concentration of the exhaust gas exiting the catalytic converter and the pre-catalyst EGO signal indicates stoichiometry after indicating a lean air/fuel ratio for a predetermined time period.

28. The method of claim 27 further comprising determining the estimated oxygen storage based on the post-catalyst EGO signal and the pre-catalyst EGO signal.

29. The method of claim 26 further comprising determining a third oxygen concentration based on a model that relates the third oxygen concentration to an estimated oxygen storage in the catalytic converter when one of the estimated oxygen storage is not equal to the desired oxygen concentration of the exhaust gas exiting the catalytic converter and the pre-catalyst EGO signal indicates stoichiometry after indicating a lean air/fuel ratio for a predetermined time period.

30. The method of claim 26 further comprising determining a post-catalyst fuel command based on a model that relates the post-catalyst fuel command to the desired oxygen concentration of the exhaust gas exiting the catalytic converter and the post-catalyst EGO signal when the desired oxygen concentration of the exhaust gas exiting the catalytic converter is not equal to the post-catalyst EGO signal.

31. The method of claim 26 further comprising determining a fourth oxygen concentration based on a model that relates the fourth oxygen concentration to the desired oxygen concentration of the exhaust gas exiting the catalytic converter and the post-catalyst EGO signal when the desired oxygen concentration of the exhaust gas exiting the catalytic converter is not equal to the post-catalyst EGO signal.

32. The method of claim 17 further comprising determining the final fuel command based on the pre-catalyst EGO signal and the expected oxygen concentration when the pre-catalyst EGO signal is not equal to the expected oxygen concentration.

* * * * *